United States Patent [19]

Johansson

[11] Patent Number: 4,753,419

[45] Date of Patent: Jun. 28, 1988

[54] HYDRAULIC LIFTING TABLE

[75] Inventor: Lars Johansson, Aby, Sweden

[73] Assignee: Hymo AB, Aby, Sweden

[21] Appl. No.: 9,948

[22] PCT Filed: Apr. 9, 1986

[86] PCT No.: PCT/SE86/00165

§ 371 Date: Nov. 24, 1986

§ 102(e) Date: Nov. 24, 1986

[87] PCT Pub. No.: WO86/06054

PCT Pub. Date: Oct. 23, 1986

[30] Foreign Application Priority Data

Apr. 16, 1985 [SE] Sweden ..... 8501852

[51] Int. Cl.[4] ..... B66F 3/22

[52] U.S. Cl. ..... 254/122; 414/402

[58] Field of Search ..... 254/9 R, 9 C, 9 B, 122, 254/124; 182/8.71, 8.72, 18; 414/391, 402, 495

[56] References Cited

U.S. PATENT DOCUMENTS

| | | | |
|---|---|---|---|
| 2,862,689 | 12/1958 | Dalrymple et al. | 254/122 |
| 3,905,494 | 9/1975 | Yatagai et al. | 414/391 |
| 4,534,544 | 8/1985 | Heide | 254/122 |

FOREIGN PATENT DOCUMENTS

| | | |
|---|---|---|
| 1207061 | 12/1965 | Fed. Rep. of Germany . |
| 2253765 | 8/1973 | Fed. Rep. of Germany . |
| 3248414 | 6/1984 | Fed. Rep. of Germany . |
| 60841 | 12/1980 | Finland . |
| 418727 | 6/1981 | Sweden . |
| 846161 | 8/1960 | United Kingdom . |

*Primary Examiner*—Frederick R. Schmidt
*Assistant Examiner*—Judy J. Hartman
*Attorney, Agent, or Firm*—Jeffers, Hoffman & Niewyk

[57] ABSTRACT

The present invention relates to an arrangement for a hydraulic lifting table of the scissor type with at least two pairs of scissor arms (1, 2) pivotally attached to one another. These are attached at their ends to a lower frame section (3) and an upper table section (4) in such a way as to be capable of pivoting and rolling. The arrangement also comprises a centrally positioned power transmission arrangement pivotally attached to the frame section, being preferably a hydraulic cylinder, the piston rod (8) of which is so arranged as to engage via rollers (9) with guide curves (10, 11). One (10) of these is attached to the frame section (3), and the other (11) is operatively connected to a pair of scissor arms (1). The guide curves (10, 11) are moved towards and away from one another by the rollers (9) for the purpose of raising the lifting table and vice versa. A characteristic feature of the invention is the fact that the table section (4) has the form of a plain symmetrical 'E', in which cross-pieces of the 'E'-shape cover the pairs of scissor arms (1, 2) and the power transmission arrangement (7, 8), and that the guide curves (10, 11) are centrally positioned in the vicinity of the hydraulic cylinder (7), and that the operative connection consists of a shaft (12) pivotally mounted in the frame section (3), which shaft constitutes the operative connection between the guide curve (11) and the pair of scissor arms (1).

2 Claims, 3 Drawing Sheets

HYDRAULIC LIFTING TABLE

The present invention relates to an arrangement for a hydraulic lifting table of the scissor type with at least two pairs of scissor arms pivotally attached to one another, which scissor arms are attached at their ends to a lower frame section and to an upper table section in such a way as to be capable of pivoting and rolling, and a centrally positioned power transmission arrangement pivotally attached to the frame section, being preferably a hydraulic clyinder, the piston rod of which is so arranged as to engage via rollers with guide curves, one of which is attached to the frame section, and the other is operatively connected to a pair of scissor arms, and which are moved towards and away from one another by means of the rollers for the purpose of raising the lifting table and vice versa.

In the case of such lifting tables of a previously disclosed kind, it is difficult to manoeuvre a load up onto the lifting table by hand using a so-called hand pallet truck; this is because the smallest difference in height between the upper surface of the lifting table and a level floor on which the lifting table is resting is so great that an inclined plane is necessary in order to equalize the difference in height. In the absence of special lifting equipment, it will be necessary, if the load weighs more than one is able to lift manually, to use the lifting table to lift both the hand pallet truck and the load.

The object of the present invention is to make available a hydraulic lifting table which permits the load, with the help of the hand pallet truck, to be placed on the lifting table, which is made possible by the table section having the form of a plain symmetrical 'E', in which the cross-pieces of the 'E'-shape cover the pairs of scissor arms and the power transmission arrangement, by the guide curves being centrally positioned, i.e. in the vicinity of the hydraulic cylinder, and by the operative connection consisting of a shaft pivotally mounted in the frame section, which shaft constitutes the operative connection between the guide curve and the pair of scissor arms.

Accessibility is further increased through the table section having the form of a plain symmetrical 'E', in which the cross-pieces of the 'E'-shape cover the pairs of scissor arms and the power transmission arrangement.

The fact that all the guide curves in accordance with a particular characteristic features are of identical profile means that the above-mentioned smallest difference in height is as small as possible.

The invention is described below in further detail with reference to the accompanying drawing, in which, FIG. 1 illustrates in perspective view one embodiment of a lifting table in accordance with the invention, with the table in a raised position.

Figure 1:
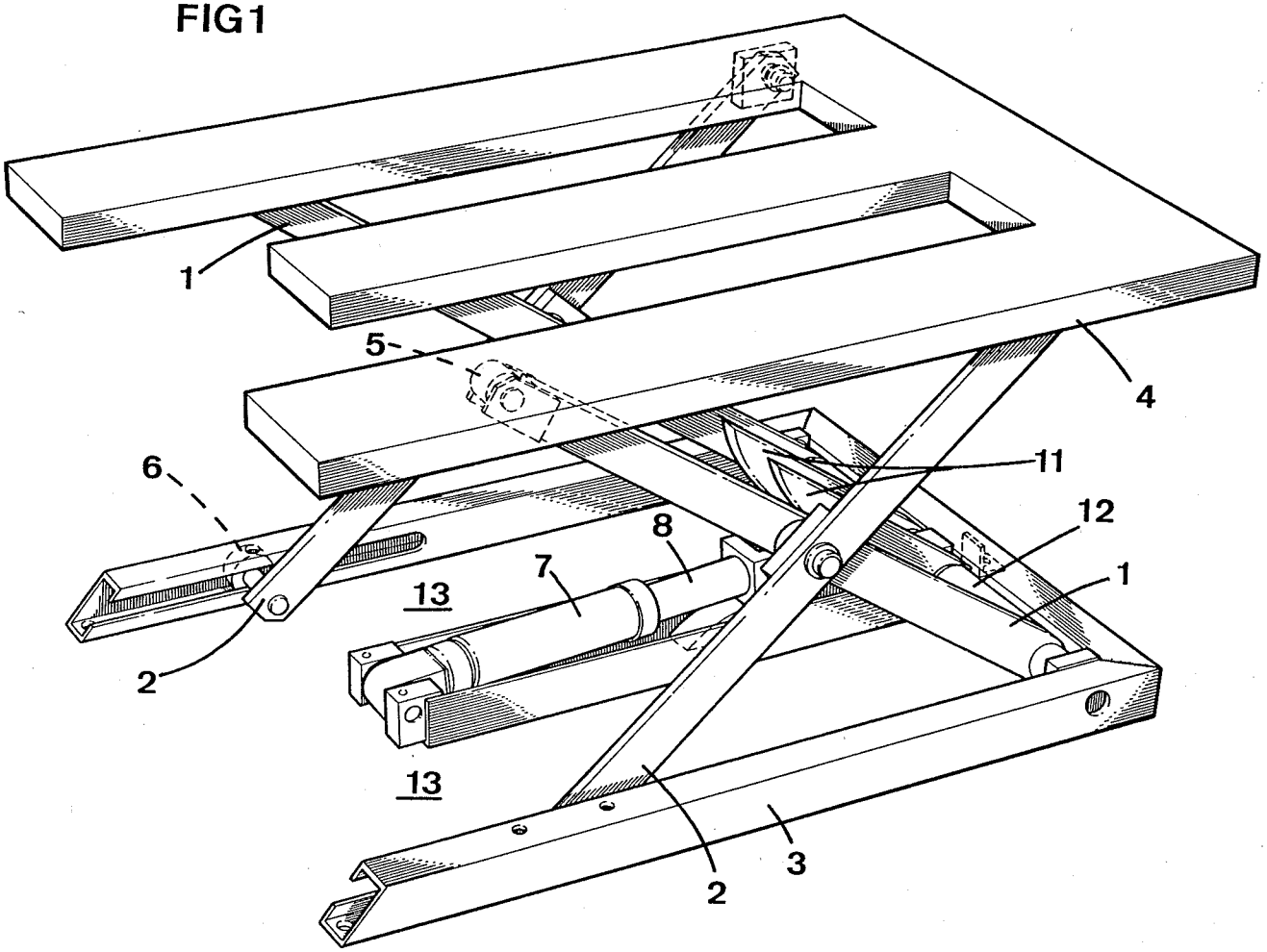

A hydraulic lifting table in accordance with the invention comprises two articulated pairs of scissor arms 1, 2, a lower frame section 3 and an upper table section 4. The pair of scissor arms 1 is connected at its lower end in such a way as to articulate with the frame section 3, and is equipped at its upper end with rollers 5 by means of which the pair of scissor arms 1 rolls against the table section 4. The pair of scissor arms 2 is similarly conencted at its upper end in such a way as to articulate with the table section 4, and is equipped at its lower end with rollers 6 enabling it to roll against the frame section 3.

For the purpose of raising and lowering the lifting table there is provided a centrally positioned power transmission arrangement 7 which is pivotally attached to the frame section 3, being preferably a hydraulic cylinder, the piston rod 8 of which is equipped at its outer end with rollers 9. These are so arranged as to engage with guide curves 10, 11, one 10 of which is attached to the frame section 3, and the other 11 is operatively connected to the pair of scissor arms 1. A construction of this kind is previously disclosed and functions as follows: as the cylinder piston is forced out, the curves 10, 11 are forced apart by the rollers 9, causing the table section 4 to be raised. A similar procedure, but in reverse, takes place for lowering the table section 4.

According to the invention the guide curves 10, 11 are also centrally positioned, i.e. in the immediate vicinity of the cylinder 7. The operative connection between the guide curves 11 and the pair of scissor arms 1 consists of a shaft 12 pivotally mounted in the frame section 3.

Figure 2:
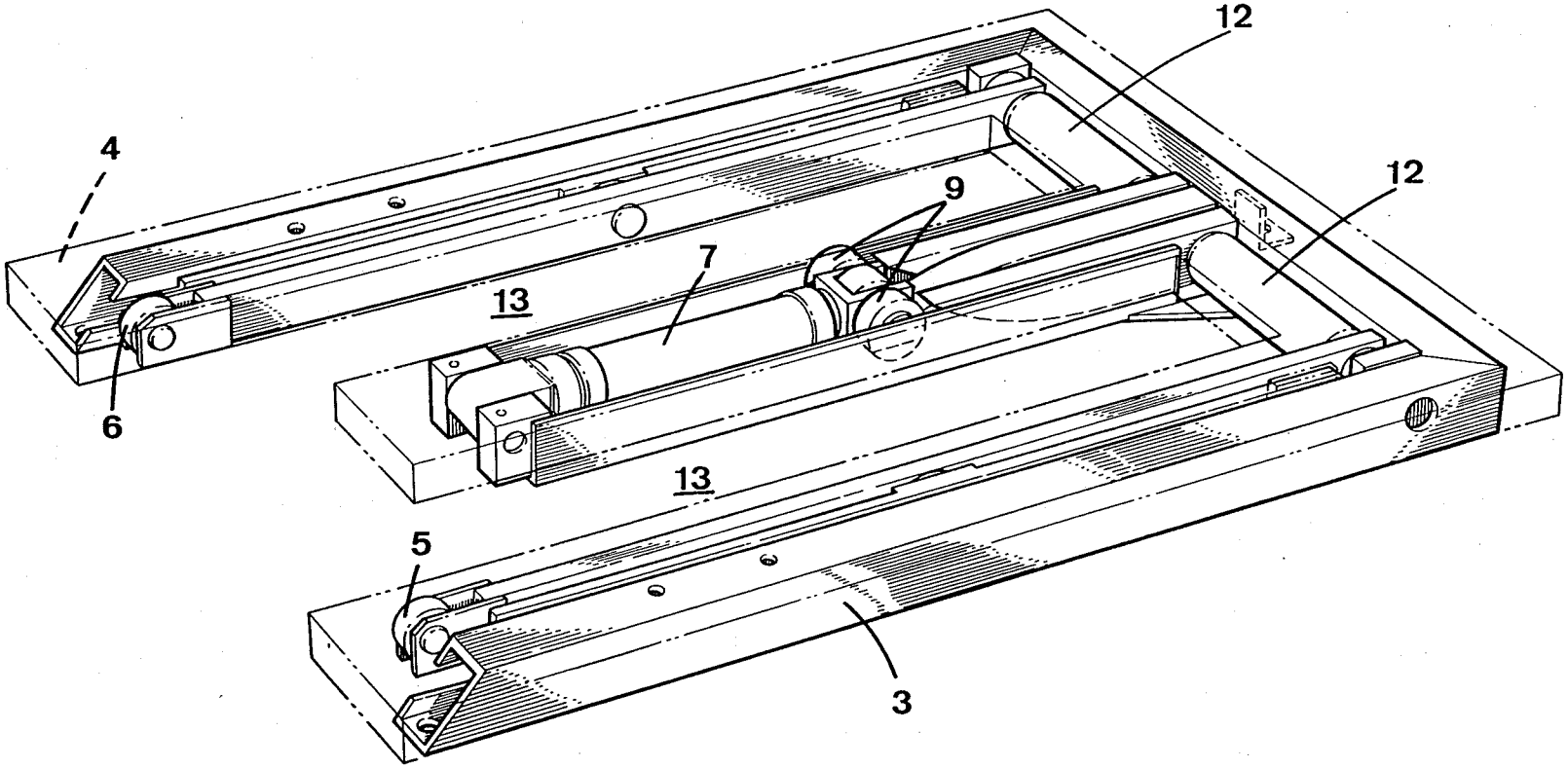
FIG. 2 is a perspective view which illustrates the lifting table in accordance with FIG. 1 in the collapsed state.
Figure 4:
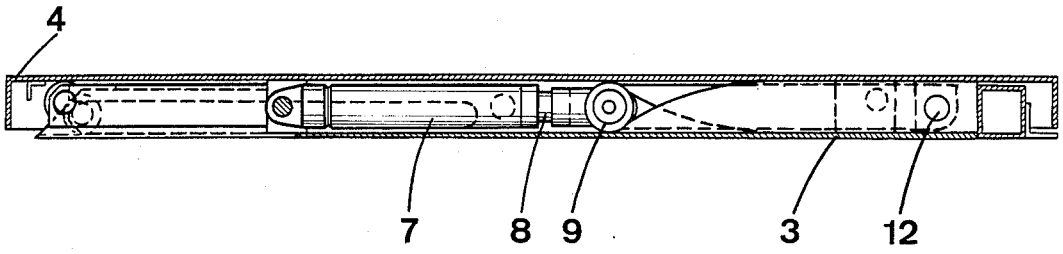
FIGS. 3 and 4 shows a cross-section through the lifting table in FIGS. 1 and 2.
Figure 3:
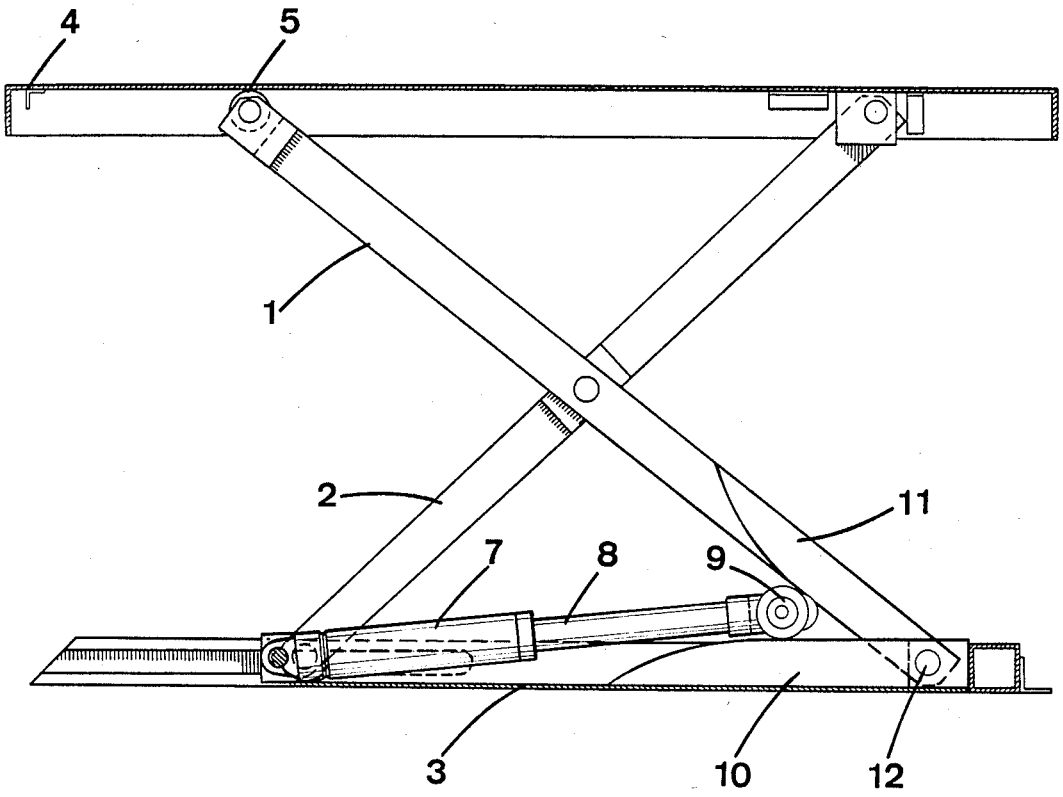

The advantage mentioned by way of introduction to the effect that the forks of a truck can be introduced into the spaces indicated by 13 in FIGS. 1 and 2 is achieved through the construction in accordance with the invention. The load which is supported by the forks can thus be positioned simply on top of the table section 4 and can then be raised by the lifting table to the desired height. The truck need not be raised in conjunction with this, but can remain on the floor. The lifing table can, of course, also be used for moving a load conveniently from the table section 4 to the forks of a fork truck.

I claim:

1. A hydraulic lifting table comprising a lower frame section, an upper "E"-shaped table section, said table section comprising a pair of outer crosspieces and a center crosspiece positioned between the outer crosspieces means for accommodating forks of a lift truck within said "E"-shaped table section and within said lower frame section, said means being spaces sufficiently wide to accommodate the forks of a lift truck, at least two pairs of scissor arms pivotally attached to on another and attached at their ends to the lower frame section and the upper "E"-shaped table section, each of said scissor arms having pivot means on one end thereof pivotally connected to one of said table section and lower frame section, and each of said scissor arms having roller means on the other end thereof in rolling engagement with the other of said table section and lower frame section, the pairs of scissor arms being covered by the respective outer crosspieces of the "E" of the table section, a centrally positioned power transmission mechanism being pivotally attached to the frame section by a shaft and having a rod equipped at its outer end with a roller, and centrally positioned first and second guide curve means engaged with the power transmission roller, said first guide curve means being attached to the frame section and said second guide curve means being operatively connected to each of a pair of parallel scissor arms by means of said shaft such that, the guide curve means, roller and power transmission mechanism are covered by the center crosspiece of the "E" of the table section.

2. The hydraulic lifting table as in claim 1 wherein all of the guide curve means are of identical profile.

* * * * *

UNITED STATES PATENT AND TRADEMARK OFFICE

CERTIFICATE OF CORRECTION

PATENT NO. : 4,753,419

DATED : June 28, 1988

INVENTOR(S) : Lars Johansson

It is certified that error appears in the above-identified patent and that said Letters Patent is hereby corrected as shown below:

Col. 1, line 68, change "conencted" to --connected--;
Claim 1, Col. 2, line 45, change "on" to --one--.

Signed and Sealed this

Sixth Day of December, 1988

*Attest:*

DONALD J. QUIGG

*Attesting Officer*

*Commissioner of Patents and Trademarks*